US010267001B1

(12) United States Patent
Douglas

(10) Patent No.: US 10,267,001 B1
(45) Date of Patent: Apr. 23, 2019

(54) DEVICE AND METHODS FOR PET WASTE COLLECTION AND DISPOSAL

(71) Applicant: Gregory Scott Douglas, Cypress, CA (US)

(72) Inventor: Gregory Scott Douglas, Cypress, CA (US)

( * ) Notice: Subject to any disclaimer, the term of this patent is extended or adjusted under 35 U.S.C. 154(b) by 0 days.

(21) Appl. No.: 16/058,913

(22) Filed: Aug. 8, 2018

(51) Int. Cl.
*E01H 1/12* (2006.01)

(52) U.S. Cl.
CPC ..... *E01H 1/1206* (2013.01); *E01H 2001/126* (2013.01)

(58) Field of Classification Search
CPC ..... E01H 1/1206; E01H 2001/122; E01H 2001/1226; E01H 2001/126; A01K 23/005
USPC ..... 294/1.3
See application file for complete search history.

(56) References Cited

U.S. PATENT DOCUMENTS 3,806,984 A * 4/1974 Hilsabeck ..... E01H 1/1206 15/257.6
3,978,540 A * 9/1976 Peck ..... E01H 1/1206 294/1.3
4,138,153 A * 2/1979 Brown ..... E01H 1/1206 15/257.1
4,948,266 A * 8/1990 Bencic ..... A47L 9/1445 220/495.08
5,186,384 A * 2/1993 Nelson ..... E01H 1/1206 229/117.14
6,116,668 A * 9/2000 Carpol ..... A41D 19/0075 2/160
D436,236 S 1/2001 Boyd et al.
D460,223 S 7/2002 Daniels
6,832,796 B1 * 12/2004 Minassians ..... E01H 1/1206 294/1.3
7,625,026 B2 * 12/2009 Lau ..... E01H 1/1206 15/257.1
7,976,083 B2 7/2011 Black et al.
9,516,864 B2 12/2016 Wang
2010/0045056 A1 * 2/2010 Greenhut ..... E01H 1/1206 294/1.3
2014/0152030 A1 * 6/2014 Van Halder ..... E01H 1/1206 294/1.3

FOREIGN PATENT DOCUMENTS

FR 2842546 A1 * 1/2004 ..... E01H 1/1206
WO WO-2012023645 A1 * 2/2012 ..... E01H 1/1206

* cited by examiner

*Primary Examiner* — Dean J Kramer
(74) *Attorney, Agent, or Firm* — Cionca IP Law P.C.; Marin Cionca

(57) ABSTRACT

A pet waste collection and disposal device comprising: a frame having an outer frame edge; a scoop; wherein the scoop is surrounded by the frame and is associated with the frame via perforations adapted to allow a detachment of the scoop from the frame creating a frame opening; and a bag having an interior surface associated with the outer frame edge; wherein the bag is in a compressed state when the device is in a folded state, and is adapted to be in an expanded state and receive the pet waste when the device is in an unfolded state; wherein the frame opening accesses the interior space, such that the bag is receives the pet waste and the scoop through the frame opening; and wherein the bag is completely encloses the frame, the pet waste, and the scoop when the bag is in the expanded state and a sealed state.

18 Claims, 6 Drawing Sheets

DEVICE AND METHODS FOR PET WASTE COLLECTION AND DISPOSAL

BACKGROUND OF INVENTION

1. Field of the Invention

The invention relates generally to pet waste collection methods and devices and more specifically to an all-in-one, disposable, portable, and compact pet waste collection kit with a detachable scoop, which allows a user to dispose of pet waste without touching the pet waste.

2. Description of the Related Art

Collecting and disposing of pet feces ("waste") is often a very unpleasant process. Pet owners often use plastic bags to pick up pet waste, which results in the user feeling the warmth and texture as well as being exposed to the odor of pet waste. This method of waste disposal can also present difficulties with picking up all of the pet waste, and also poses the risk of coming into contact with the pet waste, which can lead to coming into contact with bacteria. Methods and apparatuses for pet waste collection that are known in the art may present several problems, such as the bags ending up with pet waste on the outside of the device, which, again, can expose the pet owners to odor and the risk of coming into contact with pet waste and exposure to bacteria. Some pet waste collection bags make use of or require a reusable frame or scoop, which requires a pet owner to carry extra equipment on a walk. Reusable frames or scoops can also be inconvenient because, after use, the pet owner has to carry the soiled equipment for the rest of the walk and must also clean the equipment. Other devices known in the art for collecting pet waste may be difficult to use because a user may be unable to see all of the waste when they are covering it with a bag, and may miss some of the waste, or a flimsy scoop can bend and release some of the waste. This can result in a messy experience for the user and may also necessitate using multiple bags for a single cleanup. Still other devices known in the art for collecting pet waste may be bulky and thus difficult to carry on a walk, or the devices may require two hands to hold open and use. These devices can be difficult or impossible for a pet owner to use, particularly for those who also needs to hold a leash. Thus, there is need for a new and improved method for pet waste collection and disposal for pet owners walking their animals.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a pet waste collection and disposal device for pickup and disposal of pet waste is provided, the pet waste collection and disposal device comprising: a frame having: a rectangular shape; an outer frame edge; a flat top surface; a flat bottom surface; an upper gripping edge having a first area; and a lower scooping edge opposite to the upper gripping edge and having a second area; a scoop located at a center of the frame, the scoop being adapted for the pickup of the pet waste by having: an outer scoop edge having an upper scoop edge and a lower scoop edge, the lower scoop edge having a curved shape; and perforations, wherein the scoop is surrounded on the outer scoop edge by the frame and is associated with the frame via the perforations, and wherein the perforations are adapted to allow a detachment of the scoop from the frame, creating a frame opening; a seam extending between the upper gripping edge and the lower scooping edge, and extending through the scoop, the seam being adapted to allow the frame and the scoop to be folded in half to put the pet waste collection and disposal device into a folded state; and a bag having: an exterior surface; an interior surface defining an interior space created when the bag is an expanded state; an upper bag portion; a lower bag portion; and a plurality of handles at the upper bag portion; wherein the outer frame edge is associated with the interior surface of the bag at the upper bag portion; wherein the bag is in a compressed state between sides of the frame when the pet waste collection and disposal device is in the folded state; wherein the bag is adapted to be in the expanded state and receive the pet waste when the pet waste collection and disposal device is in an unfolded state, wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space of the bag when the bag is in the expanded state and the plurality of handles is tied over the frame, such that the bag is in a sealed state, for the disposal of the pet waste. Thus, an advantage is that the pet waste collection and disposal device reduces or eliminates many of the unpleasantries and potential health risks involved in the cleanup and disposal of pet waste. Another advantage is that much of the pet waste odor can be reduced or eliminated, and the likelihood of the pet owner coming into contact with pet waste and bacteria is also reduced or eliminated. Another advantage is that the user does not have to carry additional equipment while walking their pet, and the user does not need to clean or store the equipment after use. Another advantage is that all of the pet waste that a user needs to pick up can be completely contained within the device and no pet waste is left on the outside, which, again, can reduce health risks to the user. Another advantage is that the user can more easily, quickly, and efficiently perform their duties of pet waste cleanup and disposal, such that time spent on the task can be reduced. Another advantage is that the bend provided in the scoop, using the seam, may help provide the scoop with added strength, such that it does not collapse under the weight of any waste that the user picks up using the scoop. Another advantage is that the scoop may allow a user to pick up waste and place it into the bag with one hand, while the bag, via the frame, rests on or against another surface.

In another aspect, a pet waste collection and disposal device for pickup and disposal of pet waste is provided, the pet waste collection and disposal device comprising: a frame having an outer frame edge; a scoop located at a center of the frame, and the scoop being adapted for the pickup of the pet waste; perforations, wherein the scoop is surrounded by the frame and is associated with the frame via the perforations, and wherein the perforations are adapted to allow a detachment of the scoop from the frame, creating a frame opening; and a bag having: an interior surface defining an interior space created when the bag is in an expanded state; and means for sealing an opening of the bag; wherein the outer frame edge is associated with the interior surface of the bag; wherein the bag is in a compressed state between sides of the frame when the pet waste collection and disposal device is in a folded state, and the bag is adapted to be in the expanded state and receive the pet waste when the pet waste collection and disposal device is in an unfolded state; wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space when the bag is in the expanded state, and the means for sealing the opening of the bag are actuated, such that the bag is in a sealed state, for the disposal of the pet waste. Thus, again, an advantage is that the pet waste collection and disposal device reduces or eliminates many of the unpleasantries and potential health risks involved in the cleanup and disposal of pet waste. Another advantage is that much of the pet waste odor can be reduced or eliminated, and the likelihood of the pet owner coming into contact with pet waste and bacteria is also reduced or eliminated. Another advantage is that the user does not have to carry additional equipment while walking their pet, and the user does not need to clean or store the equipment after use. Another advantage is that all of the pet waste that a user needs to pick up can be completely contained within the device and no pet waste is left on the outside, which, again, can reduce health risks to the user. Another advantage is that the user can more easily, quickly, and efficiently perform their duties of pet waste cleanup and disposal, such that time spent on the task can be reduced. Another advantage is that the scoop may allow a user to pick up waste and place it into the bag with one hand, while the bag, via the frame, rests on or against another surface.

In another aspect, a method of collecting and disposing of pet waste using a pet waste collection and disposal device is provided, the device comprising: a frame having an outer frame edge; a scoop located at a center of the frame, and the scoop being adapted for the pickup of the pet waste; perforations, wherein the scoop is surrounded by the frame and is associated with the frame via the perforations, and wherein the perforations are adapted to allow a detachment of the scoop from the frame, creating a frame opening; and a bag having: an interior surface defining an interior space created when the bag is in an expanded state; an upper bag portion; and means for sealing an opening of the bag; wherein the outer frame edge is associated with the interior surface of the bag; wherein the bag is in a compressed state between sides of the frame when the pet waste collection and disposal device is in a folded state, and the bag is adapted to be in the expanded state and receive the pet waste when the pet waste collection and disposal device is in an unfolded state; wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space when the bag is in the expanded state, and the means for sealing the opening of the bag are actuated, such that the pet waste collection and disposal device is in a sealed state; the method comprising the steps of: providing the pet waste collection and disposal device; removing the scoop from the frame; picking up the pet waste using the scoop; depositing the pet waste through the frame opening into the interior space; depositing the scoop through the frame opening into the interior space; covering the frame with the upper bag portion; actuating the means for sealing the opening of the bag such that the pet waste collection and disposal device is in the sealed state; and disposing of the pet waste collection and disposal device. Thus, again, an advantage is that the pet waste collection and disposal device reduces or eliminates many of the unpleasantries and potential health risks involved in the cleanup and disposal of pet waste. Another advantage is that much of the pet waste odor can be reduced or eliminated, and the likelihood of the pet owner coming into contact with pet waste and bacteria is also reduced or eliminated. Another advantage is that the user does not have to carry additional equipment while walking their pet, and the user does not need to clean or store the equipment after use. Another advantage is that all of the pet waste that a user needs to pick up can be completely contained within the device and no pet waste is left on the outside, which, again, can reduce health risks to the user. Another advantage is that the user can more easily, quickly, and efficiently perform their duties of pet waste cleanup and disposal, such that time spent on the task can be reduced. Another advantage is that the scoop may allow a user to pick up waste and place it into the bag with one hand, while the bag, via the frame, rests on or against another surface.

In another aspect, a disposable pet waste collection kit is provided, for the cleanup and disposal of pet waste. The kit is provided with a support frame with a detachable scoop. The scoop may have a center vertical fold which may mimic the shape of a shovel to strengthen the scoop and prevent the scoop from unwanted bending. The edges of the frame are attached midway down the inside of a waste collection bag. The bag can completely enclose and contain the frame and bag contents. The kit is compact and entirely disposable. Thus, an advantage is that the pet waste collection device can provide the user with an all-in-one, convenient, method and device for pet waste collection and disposal, and the user does not need to come into contact with the pet waste, even through a bag. Thus, again, an advantage is that the pet waste collection and disposal device reduces or eliminates many of the unpleasantries and potential health risks involved in the cleanup and disposal of pet waste. Another advantage is that much of the pet waste odor can be reduced or eliminated, and the likelihood of the pet owner coming into contact with pet waste and bacteria is also reduced or eliminated. Another advantage is that the user does not have to carry additional equipment while walking their pet, and the user does not need to clean or store the equipment after use. Another advantage is that all of the pet waste that a user needs to pick up can be completely contained within the device and no pet waste is left on the outside, which, again, can reduce health risks to the user. Another advantage is that the user can more easily, quickly, and efficiently perform their duties of pet waste cleanup and disposal, such that time spent on the task can be reduced. Another advantage is that the bend provided in the scoop may help provide the scoop with added strength, such that it does not collapse under the weight of any waste that the user picks up using the scoop. Another advantage is that the scoop may allow a user to pick up waste and place it into the bag with one hand, while the bag, via the frame, rests on or against another surface.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
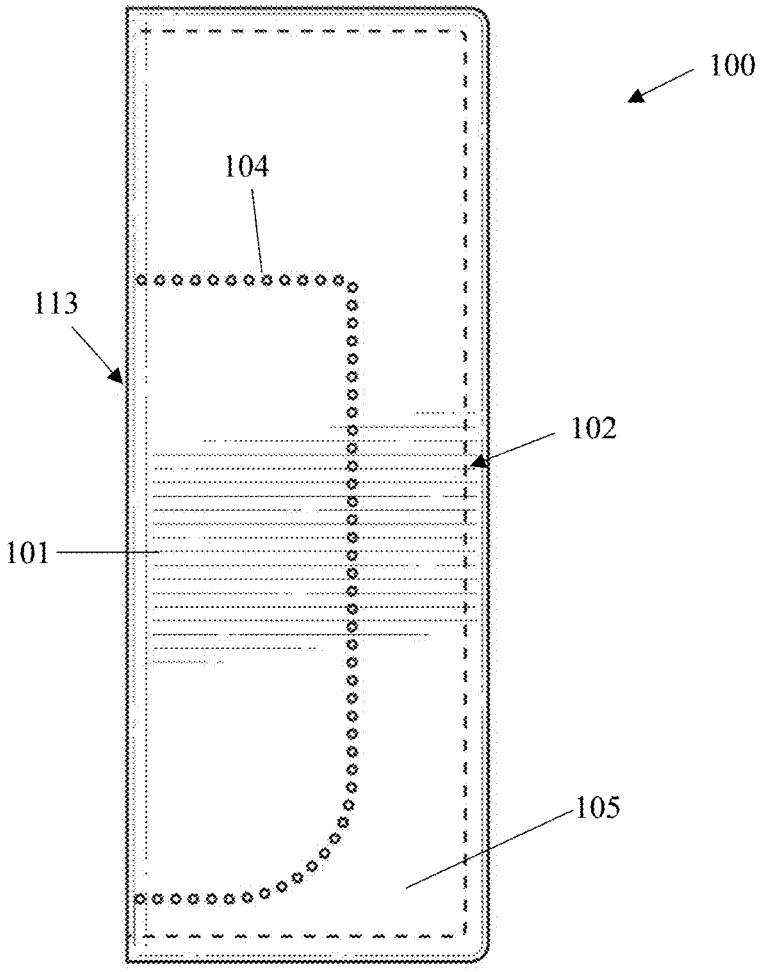
FIG. 1 illustrates a top view of a pet waste collection kit in a folded state, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a top view of a packaged pet waste collection kit ("pet waste collection kit," "pet waste collection and disposal device," "pet waste disposal device," "kit," or "device") 100 in a folded state, according to an aspect. The device may be packaged or provided in the folded state as shown, as an example. The pet waste collection kit or device 100 may be provided with a support frame ("support frame," or "frame") 105 and a waste scoop ("waste scoop" or "scoop") 101, attached along perforations 104, and folded around a waste collection bag ("waste collection bag," "waste bag," "collection bag," or "bag"), with the waste bag being in a compressed state underneath the support frame 105. The waste collection bag 102 may not be visible in the view shown in FIG. 1, and is represented by dashed lines 102, again, underneath the support frame 105. The waste bag 102, represented by the dashed line, may be compressed or folded between the sides of the frame 105 and scoop 101 when folded, such as in the example shown. The fold of the pet waste collection kit 100 may be along a provided seam 113, for example. The seam may also run lengthwise through the scoop as shown, which may provide the scoop with a fold in the middle. The provided fold along the seam may help to add strength to the scoop 101 such that it does not collapse under the weight of any pet waste or other objects that the scoop 101 picks up during use, for example. The scoop 101 may thus be used in a bent mode or bent state, as will be further discussed herein.

It should be noted that, as shown in FIG. 1, the pet waste collection kit 100 may be folded lengthwise or widthwise when packaged to provide the scoop 101 with additional stability, but the pet waste collection kit 100 may also be provided with other types of folds. The pet waste collection kit 100 may also be held in a folded state by, for example, a rubber band (not shown), or any other suitable method. The vertical lengthwise fold as shown may help to prevent the scoop from bending during waste pickup, as will be discussed in greater detail hereinafter. The scoop 101 may be surrounded or framed by the frame 105 along its outer edge, and may be associated with or attached to the frame via perforations 104 along its outer edge when the kit 100 is in a packaged state, and may be separated from the frame by the user via the perforations.

It should be noted that the kit is designed to be portable and disposable, and thus, materials such as cardboard (for the frame and scoop) and recycled or non-recycled plastic (for the waste bag) may be chosen to construct the kit. Any other suitable or appropriate lightweight, disposable, recycled or recyclable materials may also be used.

Figure 2:
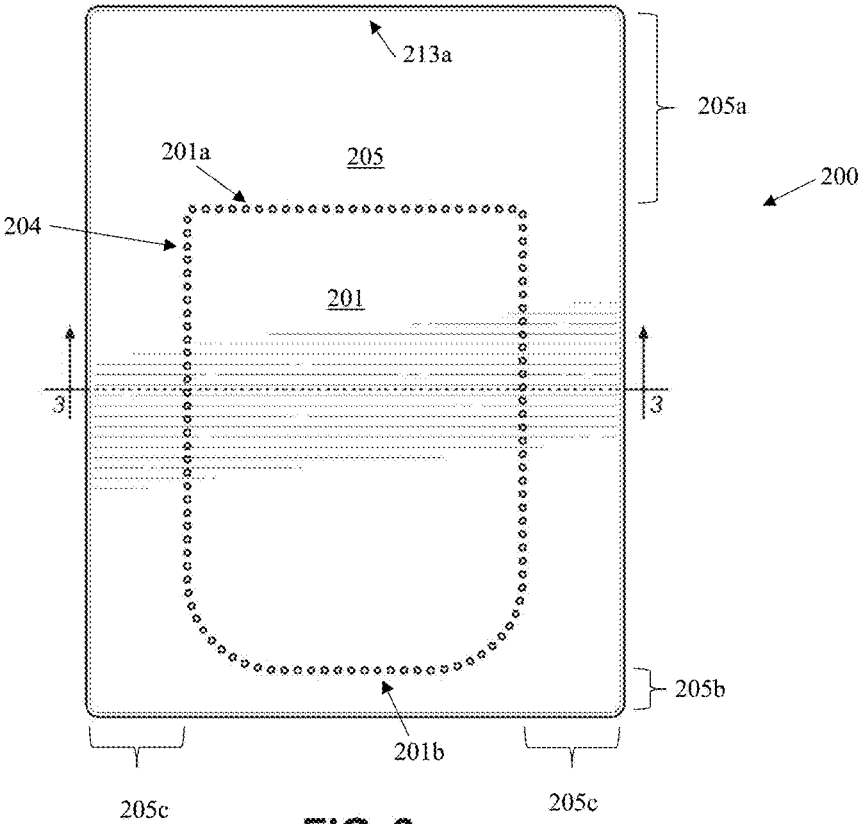
FIG. 2 illustrates a top view of the packaged pet waste collection kit in an unfolded state, according to an aspect.

FIG. 2 illustrates a top view of the packaged pet waste collection kit 200 in an unfolded state, according to an aspect. The kit 200 may be unfolded after being provided in a folded state as shown in FIG. 1, and the fold may be along a seam (as shown by 113 in FIG. 1, and not shown in FIG. 2) which may occur along a lengthwise midpoint of the frame, as represented by 213*a*. As an example, the scoop 201 may remain attached to the frame 205 along the perforations 204 after the kit 200 has been unfolded. The frame 205 and the scoop 201 may be provided in a single, integral form or sheet, and the scoop 201 may be detached from the frame 205 by the user along the perforation 204, for example. The compressed waste bag (represented by 102 in FIG. 1) may remain behind the frame and scoop, and may not be visible in the view shown in FIG. 2. The kit 200 may be in a compact state, such as the example shown in FIG. 2, when the bag is in a compressed state underneath or behind the frame and scoop.

The device 200 may be provided with an upper gripping edge ("upper gripping edge," "gripping edge," "upper edge," "upper portion," "upper grip portion," or "grip portion") 205*a*, and a lower scooping edge ("lower scooping edge," "lower edge," "scooping edge," or "lower portion") 205*b*. As an example, the upper gripping edge 205*a* may be larger than the bottom portion 205*b* such that a user may have sufficient room to hold the device, and such that a user may be provided with a convenient method of directing how to hold and scoop with the device. That is, the area of the upper gripping edge 205*a* may be larger than the area of the lower scooping edge. An advantage of the additional frame space or larger area of the upper portion 205*a* may be that the user can avoid accidentally soiling their hand during the waste cleanup or pickup process. The size of the scooping edge 205*b* may be narrow to prevent or reduce unnecessary difficulty when the user is collecting and disposing of pet waste. Keeping the scooping edge 205*b* narrow may also help to easily scoop pet waste into the collection bag, due to the reduced amount of space the waste needs to cross over. The width of the side portions ("side portions," "side edges," or "support sides") 205*c*, may be large than the height of the scooping edge 205*b*, for example, such that the support edges 205*c* provide the frame with sufficient strength and support, in order to help prevent the frame from collapsing or bending during use.

It should be noted that the scoop 201 may be provided in any suitable shape and size to assist in waste pickup. As an example, the upper edge of the scoop ("upper scoop edge") 201*a* may be flat to provide the user with an easy place to grip the scoop. An advantage may be that the user can avoid soiling their hands during waste pickup due to the scoop 201 providing a large or sufficient amount of room for holding the scoop. When the collection kit is in a packaged and folded state (as shown in FIG. 1), the scoop may be folded vertically to provide the scoop 201 with structural support. The lower edge of the scoop ("lower scoop edge") 201*b* may be curved or may have a U-shape as shown, such that, if the scoop is held by the flat upper scoop edge 201*a* by the user and while bent along the vertical fold line (i.e., the scoop is used in a bent mode or state), the scoop may mimic the shape of a shovel, as will be further discussed when referring to FIG. 6. When used in a bent state, the scoop may have a concave shape, again, similar to that of a shovel, to help prevent pet waste from falling off of the sides of the scoop 201 and securely hold the waste in place. The scoop is shown to be held by the user along the upper scoop edge and in a bent state in FIG. 6.

The scoop and the frame may, for example, be constructed from a rigid material such that the scoop and the frame are able to hold a folded or bent shape when the user bends the frame and the scoop along the seam. The rigid structure of the frame may also be advantageous by holding the bag open during the cleanup and pickup of pet waste, such that the user does not need to hold the waste bag open.

Figure 4:
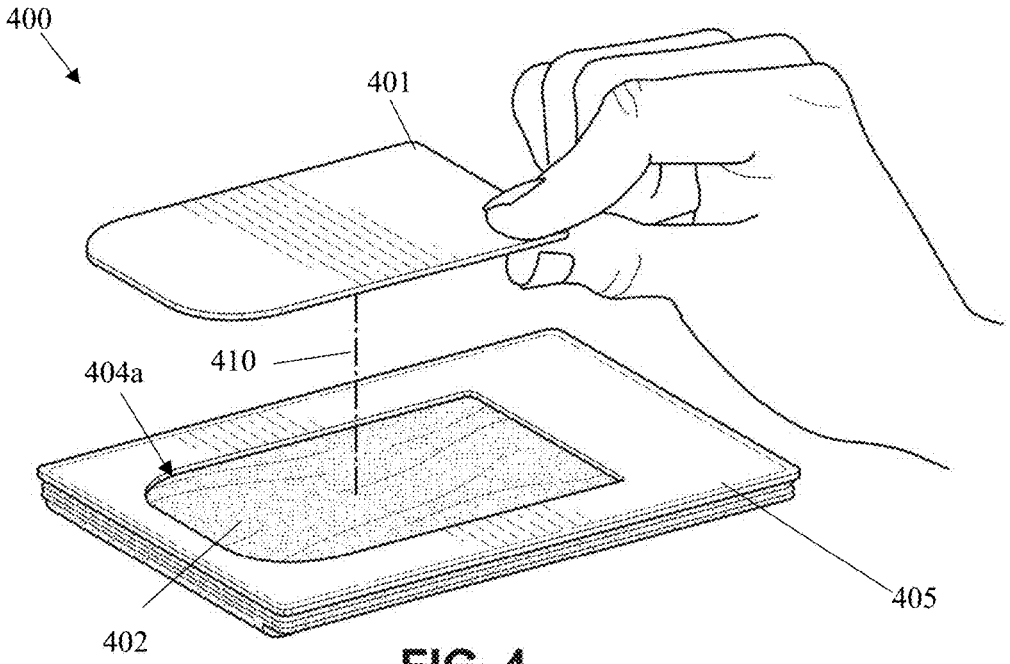
FIG. 4 illustrates a perspective view of step one of an exemplary method of using the pet waste collection kit, according to an aspect.

It may also be advantageous for the scoop to be used in a flat state, as shown by the scoop 401 of FIG. 4. In a flat state, the user may still grip the scoop along the upper scoop edge 201*a*. Using the scoop in a flat state may allow the user to more easily collect pet waste that may be difficult to collect when the scoop is in a bent state. For example, it may be easier to use the scoop 201 with a scraping motion in a flat state. The scoop is shown to be held by the user along the upper scoop edge and in the flat state in FIG. 4.

Figure 3:
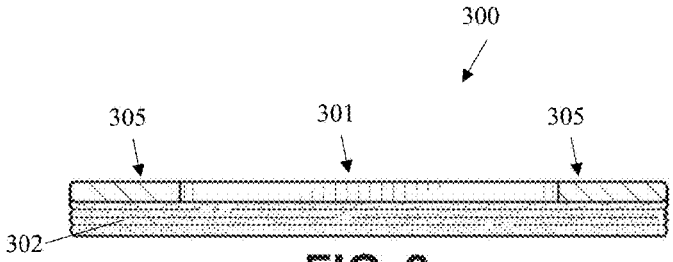
FIG. 3 illustrates a cross-sectional elevation view taken along line 3-3 of FIG. 2 of the pet waste collection kit, according to an aspect.

FIG. 3 illustrates a cross-sectional elevation view taken along line 3-3 of FIG. 2 of the pet waste collection kit 300, according to an aspect. The cross-sectional view shows an example of how the waste bag 302 may be compressed or folded underneath the frame 305 and scoop 301. As shown as an example, the bag 302 may be compressed by folding the bag 302 in a manner similar to that of an accordion. It should be noted that, as the kit is designed to be portable and easily carried by the user, the bag 302 may be compressed or folded in another appropriate manner such that the packaged collection kit 300 may be compact and thus portable.

FIG. 4 illustrates a perspective view of step one of an exemplary method of using the pet waste collection kit 400, according to an aspect. The scoop 401 may be removed or separated from the frame 405 of the pet waste collection kit 400, according to an aspect. During this step, the waste bag 402 may remain compressed underneath the frame 405. To operate the waste collection kit, the user may first detach the scoop 401 from the frame 405. The user may detach the scoop 401 by puncturing the perforation (204 of FIG. 2 and 104 of FIG. 1) and pulling the scoop 401 up and away from the frame 405, in the direction indicated by line 410 as an example. Alternatively, the user may also remove the scoop 401 by pushing the scoop 401 into the bag 402 and next removing the scoop 401 from the bag 402. Detaching the scoop from the frame may leave an opening in the frame indicated by 404*a* through which the pet waste may be deposited for disposal.

Figure 5:
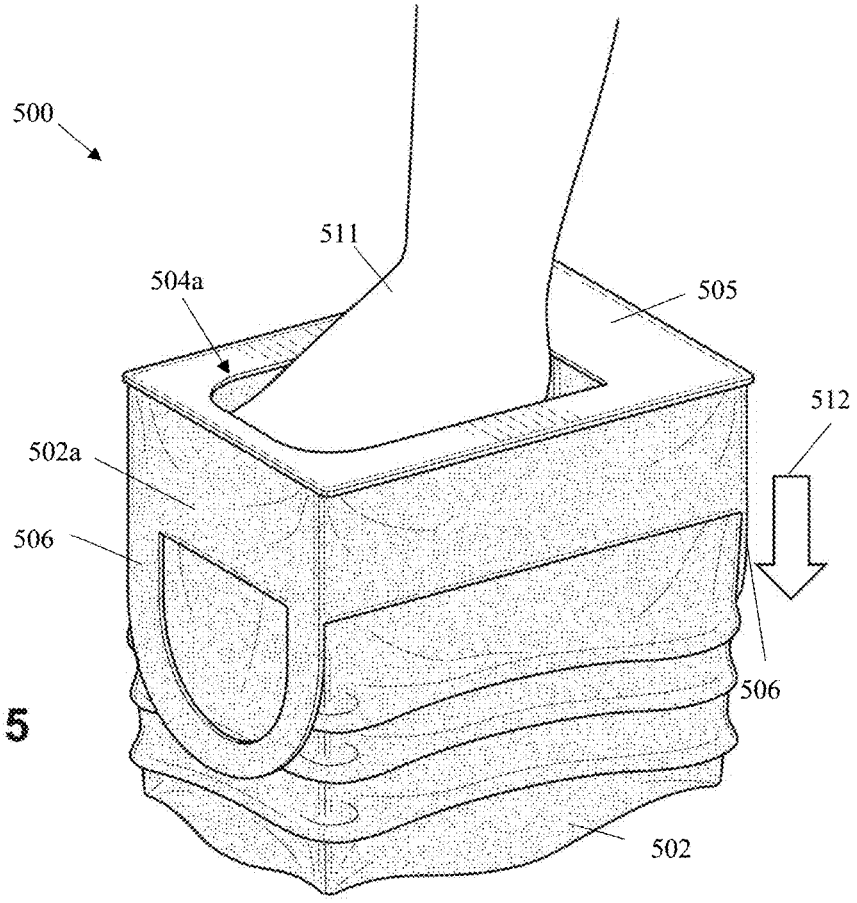
FIG. 5 illustrates a perspective view of step two of the exemplary method of using the pet waste collection kit, according to an aspect.

FIG. 5 illustrates a perspective view of step two of the exemplary method of using the pet waste collection kit 500, according to an aspect. The user may next expand the waste bag 502 of the pet waste collection kit 500. The bag 502 may be in a compressed state when the kit 500 is in a folded state, and the bag may be in an expanded state when the kit 500 is in an unfolded state, for example. After detaching the scoop (not shown) as previously discussed when referring to FIG. 4, the user may expand the waste bag 502 by inserting a hand 511 or any other suitably sized object into the opening ("frame opening" or "opening") 504*a* in the frame 505 and pushing down, such as in the direction indicated by arrow 512 as an example. The waste bag 502 may be attached to the edges of the frame with glue or another appropriate or suitable adhesive. The adhesive may create a seal between the frame 505 and the bag 502 such that pet waste does not escape though the seal during or after the pet waste cleanup and disposal process. As shown in FIG. 5, the edges of the frame 505 may be attached to the inside or interior surface 502*a* of the bag 502 with the bag handles 506 facing downward. Thus, a top portion of the waste bag 502*a* may be inside-out during this step of the method. The frame 505 may be attached to an approximate midpoint of the bag 502 so the bag can completely envelope the frame plus any contents of the waste bag 502 once the user is done collecting pet waste. Attaching the waste bag (502) to the frame 505 in this manner may also be advantageous because this configuration may allow the user to completely envelope every part of the collection kit 500 that may come into contact with pet waste during the pickup or cleanup process, thus eliminating much of the waste odor and the likelihood of the user coming into contact with pet waste.

Figure 6:
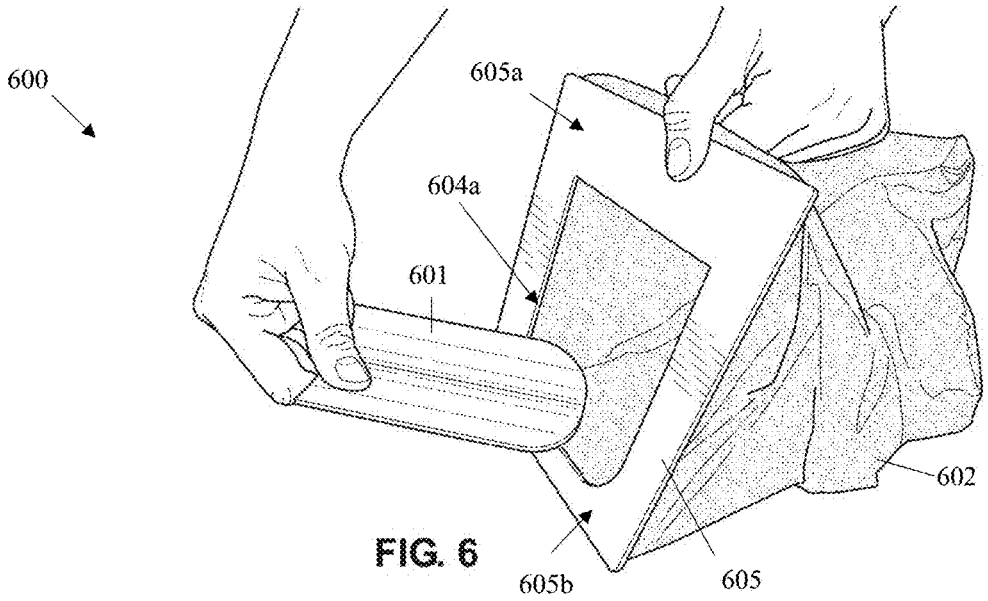
FIG. 6 illustrates a perspective view of step three of the exemplary method of using the pet waste collection kit according to an aspect.

FIG. 6 illustrates a perspective view of step three of the exemplary method of using the pet waste collection kit 600, according to an aspect. Next, the scoop 601 may be used to collect pet waste and deposit the waste into the bag 602 through the opening in the frame 604*a*. In this exemplary method of operating the collection kit, the user grips the frame 605 along the gripping edge 605*a* and places the scooping edge 605*b* on the ground or other surface and the scoop is held in the bent mode. Holding the frame 605 and scoop 601 in such a manner can allow the user to easily position the scoop underneath the pet waste and, using a scraping motion, push the pet waste through the frame opening 604*a* and into the bag 602. Once the user has collected all of the pet waste, the user can deposit the dirtied or used scoop 601 into the waste bag 602 though the opening 604*a* in the frame. The bending of the scoop 601 may also be advantageous in that it may allow the user to deposit the scoop 601 through the opening 604*a* more easily. It should be noted that, while the scoop 601 is shown to be held in the bent mode in FIG. 6, the user may also hold the scoop in a flat mode.

Figure 7:
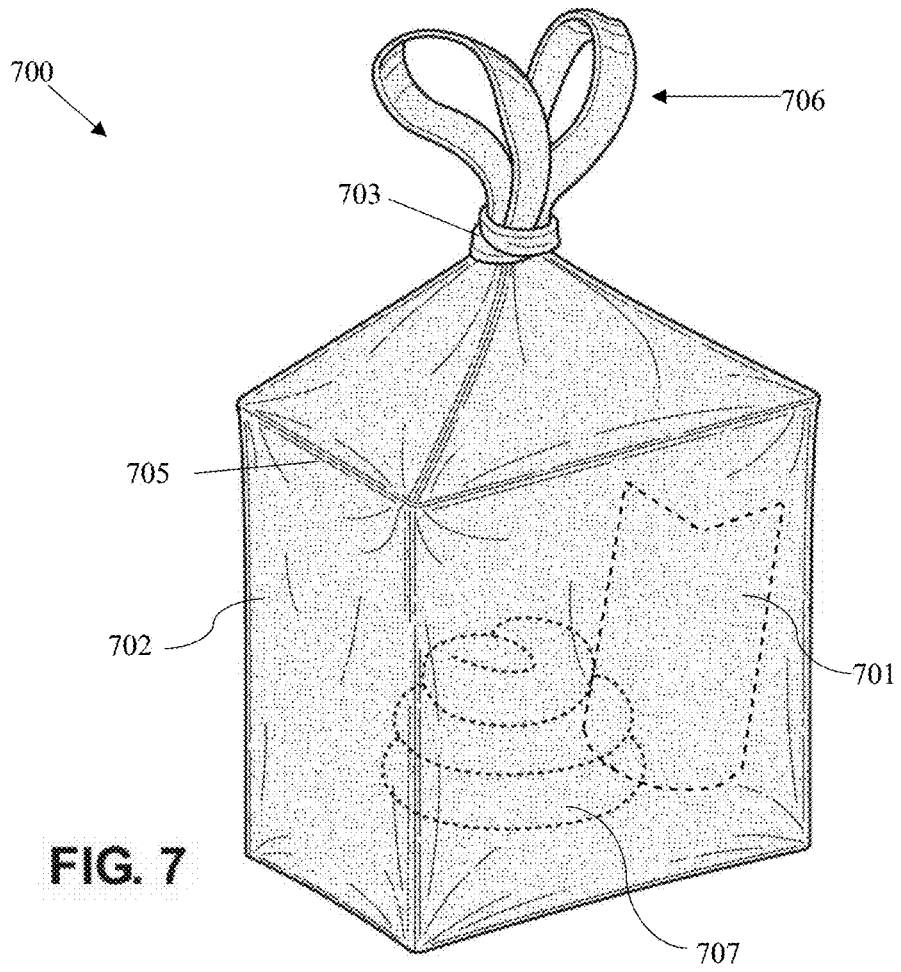
FIG. 7 illustrates a perspective view of step four of an exemplary method of using the pet waste collection kit, according to an aspect.

FIG. 7 illustrates a perspective view of step four of an exemplary method of using the pet waste collection kit 700, according to an aspect. In this step of the exemplary method, the pet waste collection kit 700 is shown in a sealed or tied state. Once the user has finished collecting pet waste 707 and has deposited the scoop 701 into the waste bag (as disclosed when referring to FIG. 6), the user may next seal the bag 702. To seal the bag, the user can use the bag handles 706 to maneuver the folded over or inside-out portion of the bag (as shown in FIG. 5). Then, the bag handles can be tied into a knot 703 to enclose the frame (represented by 705 showing a square or rectangular shape within the bag), the scoop (701), and the pet waste 707. Sealing the bag may also alleviate or reduce the smell of the pet waste. The bag may thus be leakproof and waterproof such that it can effectively seal in its contents, and may be constructed from any suitable material that allows the bag to be leakproof and waterproof.

The kit 700 may also be sealed in any suitable manner, such as with adhesive, with zipper, or with any upper portion of the bag being tied in any manner, for example. The bag may be provided with a plurality of handles, or any other grip, or the bag may be provided without handles such that the upper portion of the bag may be used to tie the bag shut. The bag may then be put into a sealed state, and then the entire kit 700 may be disposed of. As an example, the bag may be constructed from biodegradable materials such that the entire kit 700 may be disposed of.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A pet waste collection and disposal device for pickup and disposal of pet waste, the pet waste collection and disposal device comprising:

a frame having:
- a rectangular shape;
- an outer frame edge;
- a flat top surface;
- a flat bottom surface;
- an upper gripping edge having a first area; and
- a lower scooping edge opposite to the upper gripping edge and having a second area;

a scoop located at a center of the frame, the scoop being adapted for the pickup of the pet waste by having:
- an outer scoop edge having an upper scoop edge and a lower scoop edge, the lower scoop edge having a curved shape; and perforations, wherein the scoop is surrounded on the outer scoop edge by the frame and is associated with the frame via the perforations, and wherein the perforations are adapted to allow a detachment of the scoop from the frame, creating a frame opening;

a seam extending between the upper gripping edge and the lower scooping edge, and extending through the scoop, the seam being adapted to allow the frame and the scoop to be folded in half to put the pet waste collection and disposal device into a folded state; and a bag having:

an exterior surface;

an interior surface defining an interior space created when the bag is an expanded state;

an upper bag portion;

a lower bag portion; and a plurality of handles at the upper bag portion;

wherein the outer frame edge is associated with the interior surface of the bag at the upper bag portion;

wherein the bag is in a compressed state between sides of the frame when the pet waste collection and disposal device is in the folded state;

wherein the bag is adapted to be in the expanded state and receive the pet waste when the pet waste collection and disposal device is in an unfolded state, wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space of the bag when the bag is in the expanded state and the plurality of handles is tied over the frame, such that the bag is in a sealed state, for the disposal of the pet waste.

2. The device of claim 1, wherein the first area is larger than the second area.

3. The pet waste collection and disposal device of claim 1, wherein the bag is adapted to be in the compressed state by having accordion folds.

4. The pet waste collection and disposal device of claim 1, wherein the frame and the scoop are rigid such that the frame and the scoop hold a folded shape or a bent shape when a user bends the pet waste collection and disposal device along the seam.

5. The pet waste collection and disposal device of claim 1, wherein the upper scoop edge has a straight shape.

6. A pet waste collection and disposal device for pickup and disposal of pet waste, the pet waste collection and disposal device comprising:

a frame having an outer frame edge, an upper gripping edge, and a lower scooping edge opposite to the upper gripping edge;

a scoop located at a center of the frame, and the scoop being adapted for the pickup of the pet waste;

perforations, wherein the scoop is surrounded by the frame and is associated with the frame via the perforations, and wherein the perforations are adapted to allow a detachment of the scoop from the frame, creating a frame opening;

a seam extending between the upper gripping edge and the lower scooping edge, and extending through the scoop, the seam being adapted to allow the frame and the scoop to be folded in half lengthwise to put the pet waste collection and disposal device into a folded state; and a bag having:

an interior surface defining an interior space created when the bag is in an expanded state; and means for sealing an opening of the bag;

wherein the outer frame edge is associated with the interior surface of the bag;

wherein the bag is in a compressed state between sides of the frame when the pet waste collection and disposal device is in the folded state, and the bag is adapted to be in the expanded state and receive the pet waste when the pet waste collection and disposal device is in an unfolded state;

wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space when the bag is in the expanded state, and the means for sealing the opening of the bag are actuated, such that the bag is in a sealed state, for the disposal of the pet waste.

7. The pet waste collection and disposal device of claim 6, wherein the bag further comprises an upper bag portion, and the outer frame edge is associated with the interior surface of the bag at the upper bag portion.

8. The pet waste collection and disposal device of claim 6 the upper gripping edge having a first area; and the lower scooping edge opposite to the upper gripping edge having a second area.

9. The pet waste collection and disposal device of claim 8, wherein the first area is larger than the second area.

10. A method of collecting and disposing of pet waste using a pet waste collection and disposal device comprising:

a frame having an outer frame edge, an upper gripping edge, and a lower scooping edge opposite to the upper gripping edge;

a scoop located at a center of the frame, and the scoop being adapted for the pickup of the pet waste;

perforations, wherein the scoop is surrounded by the frame and is associated with the frame via the perforations, and wherein the perforations are adapted to allow a detachment of the scoop from the frame, creating a frame opening;

a seam extending between the upper gripping edge and the lower scooping edge, and extending through the scoop, the seam being adapted to allow the frame and the scoop to be folded in half lengthwise to put the pet waste collection and disposal device into a folded state; and a bag having:

an interior surface defining an interior space created when the bag is in an expanded state;

an upper bag portion; and means for sealing an opening of the bag;

wherein the outer frame edge is associated with the interior surface of the bag;

wherein the bag is in a compressed state between sides of the frame when the pet waste collection and disposal device is in the folded state, and the bag is adapted to be in the expanded state and receive the pet waste when the pet waste collection and disposal device is in an unfolded state;

wherein the frame opening accesses the interior space, such that the bag receives the pet waste and the scoop through the frame opening after the pickup of the pet waste; and wherein the bag is adapted to completely enclose and contain the frame, the pet waste, and the scoop within the interior space when the bag is in the expanded state, and the means for sealing the opening of the bag are actuated, such that the pet waste collection and disposal device is in a sealed state;

the method comprising the steps of:

providing the pet waste collection and disposal device;

removing the scoop from the frame;

picking up the pet waste using the scoop;

depositing the pet waste through the frame opening into the interior space;

depositing the scoop through the frame opening into the interior space;

covering the frame with the upper bag portion;

actuating the means for sealing the opening of the bag such that the pet waste collection and disposal device is in the sealed state; and disposing of the pet waste collection and disposal device.

11. The method of claim 10, further comprising the step of:

bending the scoop, performed after the removing step.

12. The method of claim 10, further comprising the step of:

applying a force to the bag through the frame opening to put the bag into the expanded state.

13. The method of claim 12, wherein the applying step is performed by pushing a hand of a user downwards through the frame opening.

14. The method of claim 10, further comprising the step of:

placing the frame on a surface next to the pet waste, performed before the picking up step.

15. The method of claim 10, the means for sealing the opening of the bag of the pet waste collection and disposal device further comprising a plurality of handles, wherein the actuating step comprises tying the handles together.

16. The method of claim 10, wherein the providing step is performed by providing the pet waste collection and disposal device in the folded state, and further comprising the step of: unfolding the pet waste collection and disposal device such that the device is in the unfolded state.

17. The method of claim 10, the frame further comprising the upper gripping edge having a first area; and the lower scooping edge opposite to the upper gripping edge and having a second area.

18. The method of claim 10, wherein the upper gripping edge comprises a first area, and the lower scooping edge comprises a second area; wherein the first area is larger than the second area.

* * * * *